United States Patent [19]

Waller, Jr.

[11] Patent Number: 4,669,772

[45] Date of Patent: Jun. 2, 1987

[54] SHOE CARRIER

[76] Inventor: Daniel C. Waller, Jr., 20476 Greenlawn Dr., Detroit, Mich. 48221

[21] Appl. No.: 915,526

[22] Filed: Oct. 6, 1986

[51] Int. Cl.[4] ..... A47F 7/16

[52] U.S. Cl. ..... 294/162; 294/146; 294/148

[58] Field of Search ..... 294/162, 146, 148, 145, 294/151, 166; 211/37; 12/120.5

[56] References Cited

U.S. PATENT DOCUMENTS

| | | | |
|---|---|---|---|
| 3,497,891 | 3/1970 | Voster et al. | 294/162 |
| 3,747,774 | 7/1973 | Kulik | 294/162 |

*Primary Examiner*—James B. Marbert

*Attorney, Agent, or Firm*—Joseph W. Farley

[57] ABSTRACT

A shoe carrier comprising a housing adapted to receive the rear quarter portions of a pair of shoes, and an insert member having a pair of shoe engaging portions each insertable within the rear quarter portion of one shoe projecting toward the insole. A carrying strap, having a pair of ends attached to the insert member between the shoe engaging portions and extending slidably through the top of the housing, enables the insert member and a pair of shoes engaged thereby to be drawn into the housing through an open housing bottom. When the shoes are in the housing, the heel portions of their soles are engageable by the inner surfaces of the housing ends which retain the shoes in engagement with the insert member. An alternative construction has a pair of insert members each attached to one of a pair of housing ends, a partition within the housing midway between the housing ends is engageable by the heel portions of the shoe soles, and the housing ends are hinged so as to be movable toward and away from the partition so that a pair of shoes whose inner rear quarter portions are engaged by the insert members can be positioned within and removed from the housing.

20 Claims, 5 Drawing Figures

Fig.1.
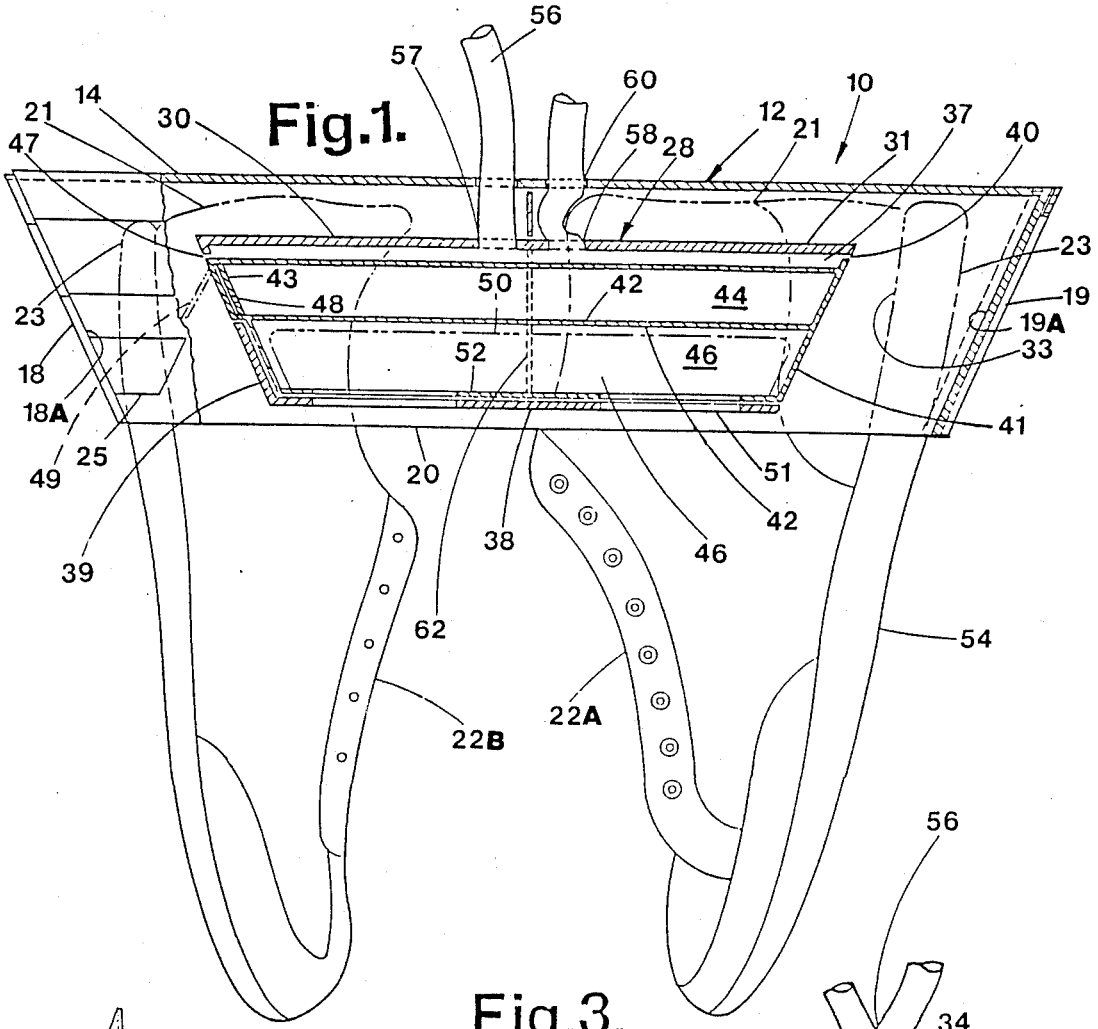
Fig.3.
Fig.2.
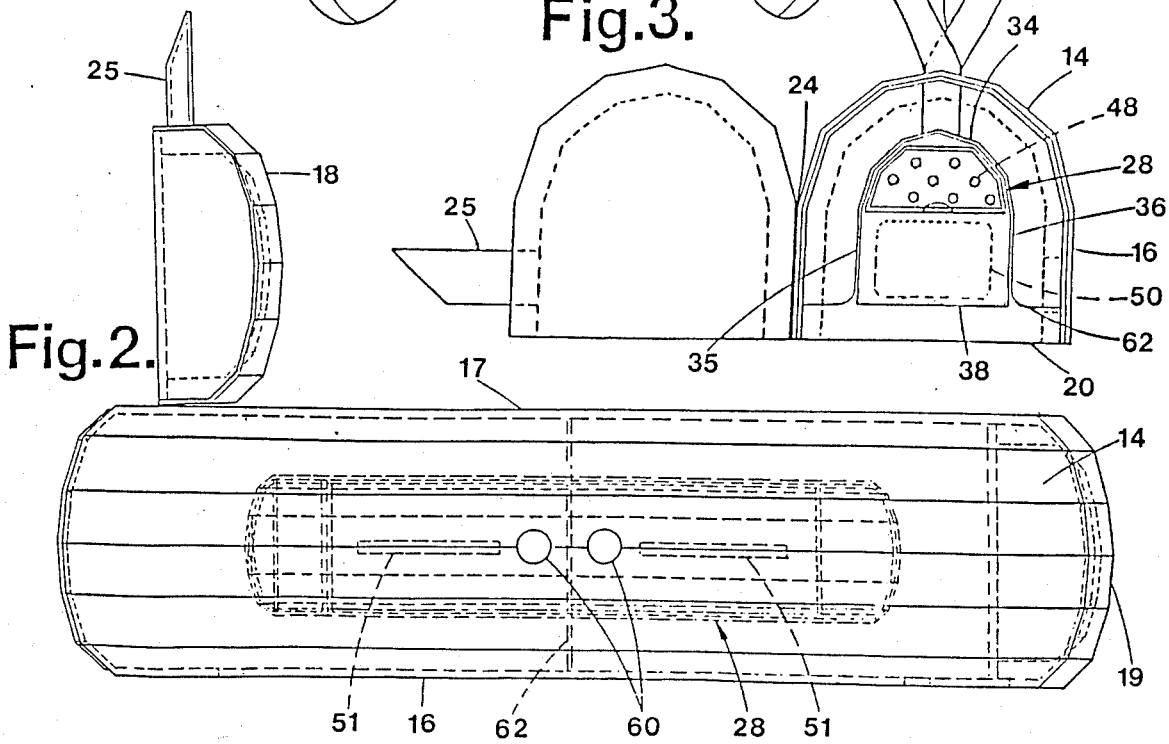

SHOE CARRIER

SUMMARY OF THE INVENTION

This invention relates to an improved carrier for shoes and to such a carrier particularly adapted for the care, storage and transportation of sport and casual shoes.

Basically, a shoe carrier of the invention comprises a housing adapted to receive and enclose at least the rear quarter portions of a pair of shoes, the housing having a pair of locating surfaces each engageable by the heel portion of the sole of one shoe of the pair. Shoe insert means positionable in the housing has a pair of shoe engaging portions each adapted to be inserted within the rear quarter portion of one shoe of the pair, and projecting toward the insole thereof. The shoe insert means is positioned within the housing by suitable means with the pair of shoe engaging portions extending toward the pair of locating surfaces, each locating surface being spaced from one of the shoe engaging portions a distance such that a pair of shoes within which the shoe engaging portions are inserted is retained in engagement therewith by the pair of locating surfaces of the housing.

In one embodiment of the invention, the insert means comprises an insert member having a pair of opposite ends, the pair of shoe engaging portions extend inwardly from the opposite ends, and the pair of locating surfaces is formed by the inner surfaces of a pair of ends of the housing. A carrying handle is attached to the insert member between the shoe engaging portions thereof, projects slidably through the top of the housing, and preferably comprises a flexible strap having ends attached to the insert member and extending through the housing on each side of a partition which is located midway between the housing ends, extends inwardly of the housing, and is engageable by the insert member to define a minimum spacing between the insert member and the housing.

The handle construction permits the housing and the insert member to be relatively moved apart for the placing of shoes on and removal from the insert member. This operation may also be facilitated by making the housing ends movable such as by a hinged mounting of each housing end.

For use with althletic or gym shoes, the insert member may be provided with an internal compartment in which a cartridge is detachably mountable, the cartridge having one or more storage chambers. For example, a foot powder may be contained in and dispensed from one storage chamber; a deodorant bar may be contained in a second storage chamber, and the insert member and cartridge may be provided with vent openings directed from the second chamber toward the interior of a pair of shoes mounted on the insert member.

In another embodiment of the invention, the insert means comprises a pair of insert members carried by a pair of ends of the housing, each insert member having a free end and one of the pair of shoe engaging portions adjacent to the free end. The housing is provided with a partition extending between a pair of sides of the housing midway between the housing ends, and the pair of locating surfaces is formed by the oppositely facing surfaces of the partition. Each housing end and the insert member carried thereby is movable relative to the housing partition to permit the insert member and a shoe engaged thereby to be positioned within and removed from the housing. This is preferably accomplished by mounting each housing end on a hinge which defines a pivotal axis extending between the housing sides parallel to the housing partiton.

The housing in its simplest form is adapted to enclose only the rear quarter portions of a pair of shoes and has an open bottom through which the front portions of the shoes project. Optionally, the housing may be divided into a storage compartment and a shoe receiving compartment.

Other features and advantages of the invention will appear from the description to follow of the embodiments disclosed in the accompanying drawings.

DESCRIPTION OF THE DRAWINGS

FIG. 1 is a side elevation, partly in section, showing a shoe carrier of the invention with alternative low and high top shoes supported therein;

FIG. 2 is a top plan view of the shoe carrier of FIG. 1 with one end thereof in open position;

FIG. 3 is an elevation showing the open end of the shoe carrier of FIG. 2;

DETAILED DESCRIPTION

Figure 4:
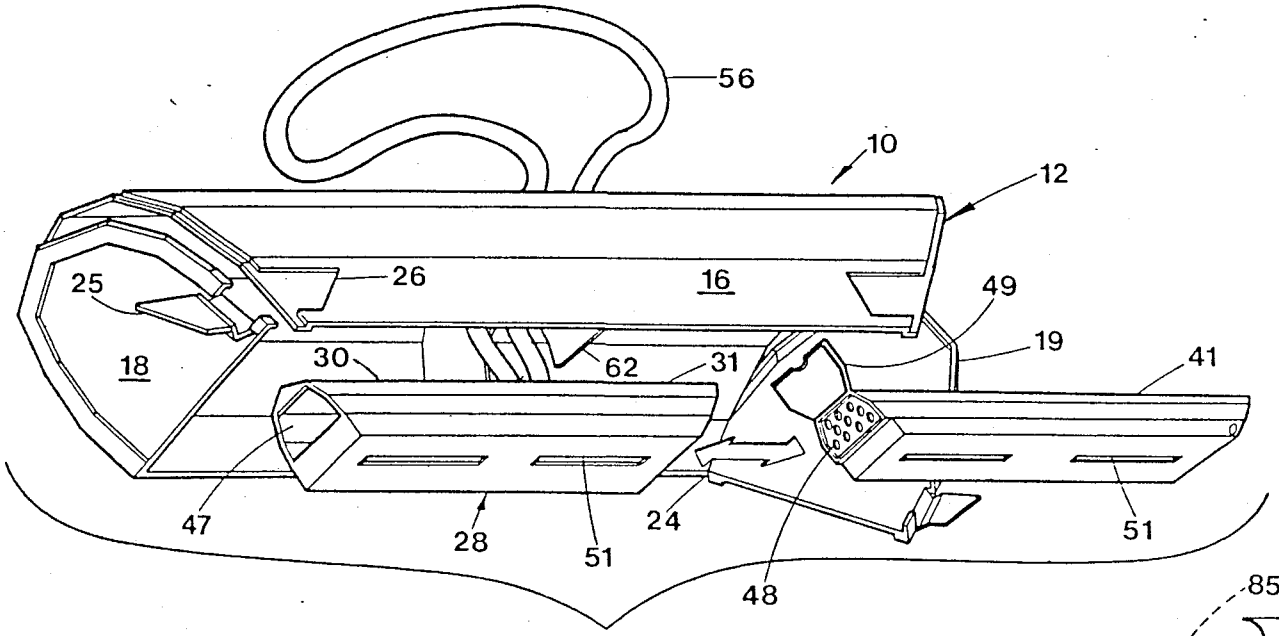
FIG. 4 is an exploded perspective view of the shoe carrier of FIGS. 1–3; and, FIG. 5 is a perspective view showing an alternative construction of a shoe carrier of the invention.

The shoe carrier 10 shown in FIGS. 1–4 comprises a housing 12 having an arched, faceted top 14, a pair of side portions 16 and 17, a pair of ends 18 and 19, and an open bottom 20. The housing is adapted to receive the rear quarter portions 21 of a pair of shoes (which may have high tops or low tops, as indicated by the shoe 22A and the shoe 22B, respectively in FIG. 1). A pair of locating surfaces is formed by the inner surfaces 18A and 19A of the housing ends 18 and 19 and each locating surface is engageable by the heel portion 23 of the sole of one of the shoes. In the particular construction illustrated, the housing ends 18 and 19 converge from the housing top toward each other; and, each of the ends 18 and 19 is connected to one of the side portions 16 and 17 by suitable hinge means 24 so as to be movable between a closed position and an open position shown by the end 18 in FIG. 2. A latch, such as VELCRO strips 25, 26, is provided for retaining each end in closed position.

Insert means in the form of an insert member 28 is positionable in the housing 12 and has a pair of shoe engaging portions 30 and 31 each extending inwardly from one of the opposite ends of the insert member 28. Each of the shoe engaging portions 30 and 31 is insertable within the rear quarter portion 21 of one of the shoes 22A or 22B and projects toward the insole 33 of the shoe. As shown in FIG. 3, the insert member 28 and the shoe engaging portions 30 and 31 thereof have an external configuration which corresponds to that of the housing, including an arched top 34 and a pair of side-portions 35 and 36, and which generally conforms to the shape of the inside surfaces of the rear quarter portion 21 of a shoe.

The insert member 28 is particularly suited for use with athletic or gym shoes and is provided with an internal compartment 37 having a bottom 38, a partial end wall 39, and an opposite open end 40. A cartridge 41 is detachably mounted in the compartment 37, being slideably insertable therein through the open end 40, as illustrated by FIG. 4. In the construction shown, the cartridge 41 is a disposable unit divided by an inner longitudinally and transversely extending baffle 42 into a first chamber 44 and a second chamber 46. The first chamber 44 is adapted to contain a powdered substance, such as a foot powder, and is provided at one end 43 with openings 48 through which the powder can be dispersed, the openings 48 being closable by a hinged door 49 accessable through an aperture 47 in the partial end wall 39 of the insert member 28. A deodorant bar 50 is adapted to be contained in the second chamber 46, and vent openings 51 provided in the bottom 52 of the second chamber and in the bottom 38 of the insert member 28 are directed towards the interior portions of shoes mounted on the shoe engaging portions 30 and 31 of the insert member as shown in FIG. 1.

Means are provided for positioning the insert member 28 within the housing 12 and these parts are proportioned so that when the insert member 28 is within the housing 12, the housing locating surfaces 18A and 19A are spaced from the shoe engaging portions 30 and 31 a distance such that a pair of shoes within which the portions 30 and 31 are inserted is retained in engagement therewith by the locating surfaces 18A and 19A. As can be seen from FIG. 1, the rear quarter portions 21 of the shoes are located between the inner top and side surfaces of the housing 12 and the outer top and side surfaces of the insert member 28; the soles 54 of the shoes are located between the surfaces 18A and 19A of the housing and the ends 39 and 40 of the insert member 28, and the soles 54 are engaged by the locating surfaces 18A and 19A.

In the construction of the carrier 10 illustrated, positioning of the insert member 28 within the housing 12 is accomplished by a handle 56 in the form of a flexible strap or loop having ends 57 and 58 attached to the insert member 28 between the shoe engaging portions 30 and 31 thereof. The strap extends slidably through holes 60 provided in the top 14 of the housing on either side of a partition or web 62 which projects inwardly from the top 14 and the side portions 16 and 17 of the housing, as best shown in FIG. 3. The web 62 is engageable by the insert member 28, defines a minimum spacing between the insert member and the top and side portions of the housing, and centers or locates the insert member 28 transversely of the housing 12. The web 62, in combination with the ends 57 and 58 of the handle, acts to locate the insert member 28 longitudinally of the housing 12.

To place a pair of shoes on the carrier 10, the housing 12 is moved relatively away from the insert member 28 on the handle 56, the housing ends 18 and 19 are opened, and the rear quarter portion 21 of each shoe is slipped over one of the shoe engaging portions 30 and 31. The housing 12 is then moved toward the insert member 28 into the position shown in FIG. 1 and the housing ends are closed, retaining the shoes within the carrier. Removal of the shoes from the carrier is accomplished in the reverse manner, or, by merely opening the housing ends and moving the shoes lengthwise of the housing 12 off of the shoe engaging portions 30 and 31.

Each of the converging housing ends 18 and 19 is adapted to engage the sole 54 of a shoe at a location spaced toward the toe end of the sole 54 from the heel end thereof. In the gym shoe type of carrier 10 shown, the housing 12 preferably encloses only the rear quarter portions of the shoes and each of the converging ends 18 and 19 forms an extension of the forward portion of the sole 54 of a shoe projecting from the housing. The carrier 10 containing a pair of shoes can thus be supported on a surface by one of its ends 18 or 19 and by the portion of the sole 54 of a shoe which projects from that one end.

Figure 5:
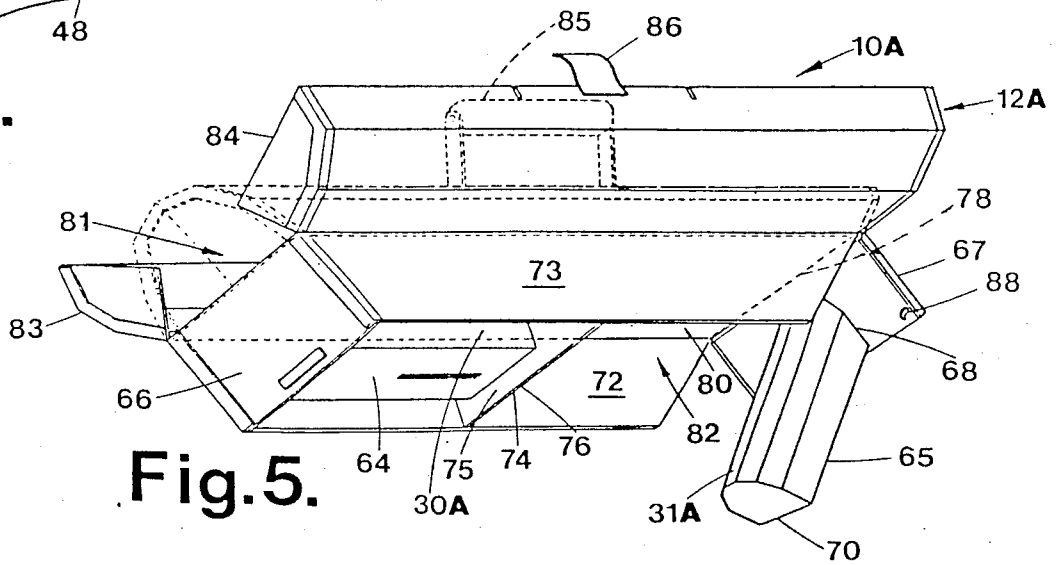

In the alternative construction of a shoe carrier 10A shown in FIG. 5, the insert means comprises a pair of insert members 64 and 65 carried by a pair of ends 66 and 67 of a housing 12A. Each of the insert members has one end 68 fixed to one of the housing ends, has a free end 70, and one of the pair of shoe engaging portions 30A and 31A is adjacent to and extends inwardly from the free end 70. Extending between side portions 72 and 73 of the housing 12A midway between the housing ends 66 and 67 is a partition 74, the oppositely facing surfaces 75 and 76 of which form the locating surfaces each engageable by the heel portion of the sole of one shoe of a pair of shoes as in the previously described embodiment of the invention. Each of the shoe engaging portions 30A and 31A is insertable within the rear quarter portion of a shoe projecting toward the insole thereof.

The insert members 64 and 65 are positionable within the housing 12A by means which, in the construction shown, comprises a hinge 78 mounting each housing end 66 and 67 on the housing 12A for movement relative to the partition 74 between the open and closed positons illustrated by the insert member 65 and the insert member 64 in FIG. 5, the hinge 78 defining a pivotal axis extending between the housing side portions 72 and 73 parallel to the partition.

A division member 80, extending longitudinally between the housing ends 66 and 67 and transversely between the housing sides 72 and 73, separates the housing 12A into an upper compartment 81 in which articles can be carried and stored, and a lower shoe receiving compartment 82. Openable covers 83 and 84 enclose the upper compartment 81, with a carrying handle 85 attached to the cover 83 and a latch 86 attached to the cover 84. The partition 74 is located in the shoe receiving compartment 82 which also includes the hinged ends 66 and 67 carrying the insert members 64 and 65.

It will be appreciated that a pair of shoes is mounted in shoe carrier 10A in the same manner as in the shoe carrier 10 of FIG. 1 but with the soles 54 oppositely oriented and facing each other. After each shoe has been placed on an insert member 64 or 65 whose housing end 66 or 67 is open, each housing end is closed and latched by suitable means such as a friction detent 88. The insert members 64 and 65 may be constructed with an internal compartment adapted to receive a disposable cartridge similar to the cartridge 41

Many other variations from the particular construction of the shoe carriers 10 and 10A shown and described are obviously possible in adapting the carrier for shoes of types other than gym shoes, or by including other features. For example, the housing 12 or 12A may be made to cover a greater portion, or all, of the shoes; the ends 18 and 19 of the housing 12 need not converge, or be openable; and the insert member may have no compartment, no bottom, or no closed ends. Also, the shoe carrier may be arranged so that the shoes are positioned in side-by-side relation in a housing.

I claim:

1. A shoe carrier comprising:

a housing having a top, a pair of side portions, and a pair of ends, said housing being adapted to receive the rear quarter portions of a pair of shoes and having a pair of locating surfaces each engageable by the heel portion of the sole of one shoe of said pair of shoes;

insert means for mounting said pair of shoes in said housing, said insert means including a pair of shoe engaging portions, each of said shoe engaging portions being insertable within the rear quarter portion of a shoe and projecting toward the inner sole thereof;

and means for positioning said insert means within said housing with said pair of shoe engaging portions extending toward said pair of locating surfaces, each of said locating surfaces being spaced from one of said shoe engaging portions a distance such that a pair of shoes within which said shoe engaging portions are inserted is retained in engagement therewith by said pair of locating surfaces.

2. A shoe carrier according to claim 1 wherein said insert means comprises an insert member having a pair of opposite ends, said pair of shoe engaging portions extends inwardly from said opposite ends, and said pair of locating surfaces is formed by the inner surfaces of said pair of housing ends.

3. A shoe carrier according to claim 2 wherein said means for positioning said insert means within said housing includes a handle attached to said insert member between the shoe engaging portions thereof and projecting through the top of said housing.

4. A shoe carrier according to claim 2 wherein said means for positioning said insert means within said housing includes a partition carried by said housing substantially midway between said pair of housing ends, said partition projecting inwardly from the top and sides of said housing and being engageable by said insert member to define a minimum spacing between said insert member and the top and side portions of said housing.

5. A shoe carrier according to claim 4 wherein said means for positioning said insert means within said housing further includes a handle in the form of a flexible strap having ends attached to said insert member between the shoe engaging portions thereof, said strap extending slidably through the top of said housing on each side of said partition.

6. A shoe carrier according to claim 5 wherein said housing ends converge toward each other, hinge means for connecting each of said housing ends to one of said pair of side portions whereby each of said housing ends is movable between a closed and an open position, and latch means for retaining each of said housing ends in closed position.

7. A shoe carrier according to claim 6 wherein each of said converging housing ends is adapted to engage the sole of a shoe at a location spaced toward the toe end of the sole from the heel end of the sole

8. A shoe carrier according to claim 7 wherein said housing is adapted to enclose only the rear quarter portions of a pair of shoes, and each of said converging housing ends forms an extension of the front portion of the sole of a shoe projecting from said housing.

9. A shoe carrier according to claim 8 wherein said insert member is provided with an internal compartment, and a cartridge is detachably mountable in said internal compartment.

10. A shoe carrier according to claim 9 wherein said cartridge is provided with a first chamber adapted to contain a powdered substance, said first chamber having a closeable opening through which said powdered substance is dispensable.

11. A shoe carrier according to claim 10 wherein said cartridge is provided with a second chamber adapted to contain a deodorant bar, said second chamber being separate from said first chamber, and said insert member and said cartridge each have vent openings directed from said second chamber toward the interior portions of a pair of shoes mounted on said shoe engaging portions of said insert member

12. A shoe carrier according to claim 1 wherein said insert member is provided with an internal compartment, a cartridge is detachably mountable in said internal compartment, said cartridge having a first chamber adapted to contain a powdered substance, said first chamber having a closable opening through which said powdered substance can be dispensed.

13. A shoe carrier according to claim 12 wherein said cartridge is provided with a second chamber adapted to contain a deoderant bar, said second chamber being separate from said first chamber, and said second chamber and said insert member have openings directed toward the interior portions of a pair of shoes mounted on said shoe engaging portions of said insert member.

14. A shoe carrier according to claim 1 wherein said insert member is provided with an internal compartment, a cartridge adapted to contain a deoderant bar is detachably mountable in said internal compartment, said cartridge and said insert member having vent openings directed toward the interior portions of a pair of shoes mounted on said shoe engaging portions of said insert member.

15. A shoe carrier according to claim 1 wherein said insert member is provided with an internal compartment.

16. A shoe carrier according to claim 1 wherein said insert means comprises a pair of insert members carried by said pair of housing ends, each of said insert members having a free end and one of said pair of shoe engaging portions adjacent to the free end, said housing includes a partition extending between said side portions substantially midway between said pair of housing ends, said pair of locating surfaces being formed by oppositely facing surfaces of said partition, and said means for positioning said insert means within said housing comprises means mounting each housing end for movement relative to said partition between an open position and a closed position.

17. A shoe carrier according to claim 16 wherein said means mounting each housing end comprises a hinge defining a pivotal axis extending between said housing side portions substantially parallel to said partition.

18. A shoe carrier according to claim 17 wherein said housing includes a division member extending longitudinally between said pair of ends and transversely between said pair of side portions, said division member separating said housing into an upper storage compartment and a lower shoe receiving compartment, said partition is located in said shoe receiving compartment, and each housing end carrying an insert member forms one end of said shoe receiving compartment.

19. A shoe carrier comprising:

a housing adapted to receive the rear quarter portion of a shoe and having a locating surface engageable by the heel portion of the sole of said shoe;

an insert member having a shoe engaging portion insertable within the rear quarter portion of said shoe and projecting toward the insole of said shoe; and, means for positioning said insert member in said housing with said shoe engaging portion extending toward said locating surface, said locating surface being spaced from said shoe engaging portion a distance such that a shoe within which said shoe engaging portion is inserted is retained in engagement therewith by said locating surface.

20. A shoe carrier according to claim 19 wherein said insert member is carried by said housing and is movable toward and away from said locating surface.

* * * * *